United States Patent [19]

Slate

[11] 4,392,021

[45] Jul. 5, 1983

[54] SECURE FACSIMILE TRANSMISSION SYSTEM USING TIME-DELAY MODULATION

[75] Inventor: Matthew W. Slate, Sudbury, Mass.

[73] Assignee: Technical Communications Corporation, Concord, Mass.

[21] Appl. No.: 172,819

[22] Filed: Jul. 28, 1980

[51] Int. Cl.[3] ..... H04K 1/06

[52] U.S. Cl. ..... 179/1.5 R; 178/22.04; 178/22.19; 455/26

[58] Field of Search ..... 179/1.5 R, 15.55 T; 178/22.19, 22.04; 358/114; 455/26

[56] References Cited

U.S. PATENT DOCUMENTS

| | | | |
|---|---|---|---|
| 2,403,059 | 7/1946 | Dillenback . | |
| 2,414,101 | 1/1947 | Hogan et al. . | |
| 2,437,255 | 3/1948 | Hogan et al. . | |
| 2,552,548 | 5/1951 | Friedman . | |
| 2,554,507 | 5/1951 | Smith . | |
| 2,645,677 | 7/1953 | Young, Jr. . | |
| 2,707,208 | 4/1955 | Smith . | |
| 2,889,399 | 6/1959 | Hammond, Jr. . | |
| 3,261,911 | 7/1966 | Bailey et al. . | |
| 3,384,705 | 5/1968 | Rosen . | |
| 3,507,980 | 4/1970 | Rugaber et al. . | |
| 3,715,478 | 2/1973 | Vasseur . | |
| 3,813,493 | 5/1974 | Hughes . | |
| 3,846,827 | 11/1974 | Eppler, Jr. | 179/15.55 T |
| 3,959,597 | 5/1976 | Keiser | 179/15.55 T |
| 3,999,005 | 12/1976 | Robert . | |
| 4,040,093 | 8/1977 | Nakagome et al. . | |
| 4,058,830 | 11/1977 | Guinet | 358/114 |
| 4,087,626 | 5/1978 | Brader | 178/22.19 |
| 4,091,423 | 5/1978 | Branscome . | |
| 4,099,027 | 7/1978 | Whitten . | |
| 4,217,469 | 8/1980 | Martelli | 179/1.5 R |
| 4,221,931 | 9/1980 | Seiler | 178/22.04 |
| 4,302,628 | 11/1981 | Akrich et al. | 179/1.5 R |

*Primary Examiner*—Sal Cangialosi
*Attorney, Agent, or Firm*—Cesari and McKenna

[57] ABSTRACT

Method and apparatus for secure transmission of analog signals, particularly facsimile signals. The analog signal is first converted to a frequency-modulated signal, if not already one, and is then converted to a sequence of digital words representing the instantaneous frequency thereof, by sampling at a fixed rate. Next the digital words representing the sample values are written in sequence into a buffer memory, at the constant sampling rate. The digital words are then read out of the memory at a different, pseudo-randomly variable rate and converted back to an analog FM signal for transmission. The transmitted signal is, thus, a time-delay-modulated version of the original FM signal. Optionally, the digital word values may be transformed before being converted back to analog frequency form, so that the modulation content of the transmitted signal is scrambled, as well. Further security may be obtained by reading out from the memory in a pattern which differs from the write-in address pattern.

The read-out rate from the memory is varied by changing the clocking rate of the read-out operation at pseudo-random times, to select the read-out rate from a plurality of available rates. The available rates include at least one which is faster that the write-in rate and one which is slower than the write-in rate. To avoid underflow or overflow of data at the memory, detection of an incipient underflow or overflow condition causes the read-out rate to be changed, respectively, from a faster-than-write-in rate to a slower-than-write-in rate, and vice versa; when the fast/slow nature of the rate is changed, the selection of the new rate is made pseudo-randomly from among the available choices. Also, the fast/slow nature of the rate may be reversed pseudo-randomly, either at random times or at preselected points.

20 Claims, 8 Drawing Figures

SECURE FACSIMILE TRANSMISSION SYSTEM USING TIME-DELAY MODULATION

FIELD OF THE INVENTION

This invention relates generally to privacy transmission systems for information communication and, more particularly, to a facsimile privacy system adapted to enhance the privacy of the transmission of facsimile signals.

BACKGROUND OF THE INVENTION

Facsimile (or FAX) transmission systems are well known in the prior art for point-to-point transmission of pictorial information. Facsimile transmission is particularly widely used for transmitting messages which are in a time-stationary graphic form, such as writing, typewriting, charts, graphs, pictures, photographs, etc. The transmission system may be either analog or digital and may employ any convenient modulation technique. In the past, commercial facsimile systems have employed primarily analog amplitude or frequency modulation, but digital systems may become more common in the future.

Often, it is desirable to insure the privacy of a communication between the point of origin and the intended destination, such that the transmission over an unsecure channel will be unintelligible to third parties who intentionally or unintentionally intercept the transmission.

In particular, various types of privacy systems already are well known for rendering facsimile transmissions unintelligible for transmission over an exposed transmission link, to make difficult or impossible reconstruction of the message content by unauthorized receivers.

Often, however, in facsimile systems graphic information to be transmitted may include one or more straight lines perpendicular to the direction of scanning of the input medium, or nearly so. An example would be plots of well logs showing the results of geological surveying and exploration for gas and oil wells. Such a line (or lines) may or may not be a significant portion of the message. More importantly, though, if not scrambled effectively it (or they) may provide an obvious clue to the scrambling algorithm, thereby permitting the unauthorized recipient to figure out how to decode the transmission.

In a typical facsimile transmission system, the image to be transmitted is placed on a transparent, rotating drum and a stationary optical sensor "reads" the image. The sensor is advanced in a direction parallel to the axis of drum rotation, at a rate much slower than the rotation rate of the drum, to do a line-by-line scan of the image. Thus, if the image contains a straight line perpendicular to the direction of scanning, as the drum rotates the sensor periodically will detect the line. Such detection of the line by the sensor will cause an abrupt change in the "clear" (i.e., unscrambled) facsimile signal generated from the sensor's output. If the scrambling algorithm transforms this abrupt change, in real time, into any abrupt change in the scrambled facsimile signal, the periodicity of the sampling is revealed thereby; in turn, the periodicity reveals both the scanning rate and the presence and orientation of the line. This information may permit the eventual unscrambling of the entire message.

Consequently, in any system of this type, designed for the private transmission of facsimile messages, it is essential to provide a scrambling technique which can hide the presence of a line perpendicular to the direction of scan.

There appear to be basically two ways to hide the presence of such a simple straight line. In the first method, the repetitive nature of the scanner signal is hidden by moving the abrupt transition in the scrambled signal to a different time during the scan period for each line in the scan—i.e., randomizing the time of occurrence of the abrupt transition. In the second method, the fact of the existence of an abrupt transition is disguised by transmitting a scrambled signal that is not just a one-for-one transformation of the instantaneous value of the clear signal. The former approach is used in the present invention; additionally, the latter technique may be combined therewith, if the added security is desired and the additional complexity can be tolerated.

SUMMARY OF THE INVENTION

The repetitive nature of the clear facsimile signal may be disguised by varying randomly the optical scanning rate, but that would add greatly to the mechanical complexity of the scanner. Alternatively, therefore, electrical signal processing may be used to like effect. Thus, the transmission of the analog scanner signal may be modulated by a pseudo-randomly varying analog time delay, or the scanner signal may be processed digitally—varying either the sampling rate or the sample processing transmission rate. Regardless of the implementation, a pseudo-randomly varying time delay is established between the detection of a point by the scanner and its transmission over the communication channel. This technique is therefore applicable to both analog and digital signal processing; the time delay may be provided, for example, by the use of either shift registers or RAM storage.

Conventional facsimile systems use analog transmission techniques—primarily either amplitude or frequency modulation within an audio bandwidth. Such analog signals can be stored directly in CCD shift registers by clocking the analog signals into the CCD shift register at a suitable rate. If digital techniques are employed, the analog signal must be sampled periodically a large number of times for each scan line, and the samples then converted to digital counterparts. After digital processing of the samples (optionally including some scrambling of sample representations), they are converted back to analog form for transmission of the scrambled message. Alternatively, the scrambled digital signal may be transmitted in digital form, with appropriate transmission rate variation.

The digitizing process introduces quantization noise that, in principle, can be reduced to any desired degree by improving the accuracy and resolution of the digitizing operation. No additional noise is introduced by the use of digital shift registers or RAMS.

The quantization noise problem is avoided if analog processing is used, since no noise is introduced merely by applying an analog signal to a CCD shift register. However, imperfections in the shift register will cause the introduction of a noise which increases with shift register length and time delay; and, unfortunately, there is a practical limit below which this noise cannot be reduced by the customary expediency of increasing clocking frequency (and thereby reducing time delay). Thus, for short delays, analog processing has the benefits of simplicity and provides fair performance; but for longer delays, digital techniques work where analog will not. The particular embodiment described below illustrates a digital processing system with analog signal transmission.

Theoretically, any variation of frequency in the analog clear, (i.e., unscrambled) facsimile signal produces a spectrum, rather than a single frequency; however, when the sampling rate of the analog-to-digital conversion is sufficiently high in comparison to the rate of change of the analog signal, the analog signal can be considered approximately as a single frequency for each sample. Under these conditions, an FM facsimile signal is amenable to the processing described herein.

Naturally, if an amplitude modulated facsimile signal is available, it may be transformed to a frequency modulated signal by conventional techniques, so that the present invention is applicable to either modulation scheme. Time-delay modulation of an analog signal, expands the frequency spectrum when the delay is decreasing and compresses the spectrum while the delay is increasing. Therefore, such modulation could have the deleterious effect of at certain times shifting a signal near the high-frequency end of the audio band to a frequency outside the audio band, so that it would be lost when transmitted over an audio bandwidth channel. Even if the signal is shifted to another frequency within the band, where it is transmitted at a different amplitude, an amplitude modulation will result which may be objectionable. Time-delay modulation of a series of digital words each of which represent an "instantaneous" amplitude of the signal—i.e., the output of a conventional signal digitizer for a short sample—will have precisely the same effect when the digital words are converted back to analog and transmitted over the channel. This phenomenon is independent of the form of modulation of the signal. In contrast, however, time-delay modulation of a series of digital words that represent the "instantaneous" frequency of a constant-amplitude analog signal will produce no frequency expansion or compression when the words are converted back to the analog frequency. Therefore, the bandwidth is conserved, and the loss or distortion of portions of the signal that occur with amplitude-to-digital conversion do not occur. Consequently only a frequency-modulated signal should be time-delay modulated and an amplitude-modulated signal should be converted to frequency modulation before any attempt is made at time-delay scrambling.

Consequently, a conventional analog facsimile scanner employing frequency modulation provides the clear facsimile signal for processing and transmission in the description below. This signal is sampled periodically, line-by-line, to obtain picture element (pixel) values which are then digitized and scrambled. The transmitted signal may be analog or digital. For completeness, the use of analog signal transmission is illustrated between the sending and receiving location; if digital transmission is used, part of the analog system (and its description) simply becomes superfluous.

The scrambling technique of the present invention starts with the generation of digital words (i.e., picture element or pixel values) which are to be scrambled. The sampling technique, when applied to an FM signal, produces digital words which represent the "instantaneous" dominant frequency in and the characterizing gray scale (or color) value of each sample. These digital words are entered (i.e., written), in sequence, into a storage means, typically a random-access read/write memory, or RAM. At some later time, the digital words are read out of the storage means, either in the same sequence or in some rearranged sequence. For example, some (or all) blocks of words may be read out in reverse order or in some other scrambled order or combination of orders. They are then transformed back to an analog signal which is delivered to the facsimile receiver at the receiving site for reconstruction of the original message.

If the time delay between writing a digital word into the storage means and reading it out is varied, rather than constant, the signal is effectively "expanded" or "compressed" in time in accordance with the delay variation. When this technique is applied to a raster scan system, such as conventional analog facsimile, the pixels of the original image will not line up in a conventionally reconstructed image in their original relationship even if their order is not rearranged for transmission; indeed, the image content will be destroyed unless the reconstruction technique reverses the effect of the time delay variations. The scrambling of the image is even more acute when the delay variation is greater than the scan time per line, since that condition can cause a line to be broken up in the direction of the scan and even to wrap over from one line to the next.

If the transmission order of the pixel values does not correspond to the order in which they were sampled, further scrambling is provided, independent of the time delay modulation scrambling. The combination of the two techniques provides a high degree of security, while adding negligibly to the system hardware needed for time-delay modulation alone.

When a RAM is used for storage, two signals control its operation. A first signal controls the timing of writing and a second controls the timing of reading. Either or both signals may be varied to create a variable time delay. In the preferred embodiment, the writing rate is constant but the reading rate is varied pseudo-randomly.

To recover (or reconstruct) the original message at the receiving site, similar, but reverse, processing must be used. An "inverted" variable time delay must be introduced by the decoding unit and the pattern of this delay must be coordinated with that introduced by the encoding unit, so that the net effect of the two cascaded variable delays is to introduce a total time delay (i.e., transmit delay plus receive delay) which is constant.

In addition to introducing such time-delay modulation, the encoding unit may scramble the frequency (or other modulation variable) content of the message on a pixel-by-pixel or other basis. That is, the frequency transmitted to represent a particular pixel may be made to be some scrambled version of the frequency provided by the clear fax signal, through use of a suitably implemented analog or digital frequency transformation. Naturally, the opposite transformation then must be made at the receiving unit to recover the frequency (i.e., modulation) content of the original image.

The pixel samples of the analog facsimile signal will necessarily be quantized and a finite number of bits will be used in the digital system for each sample; the number of bits per sample will depend on the frequency or gray-scale resolution required. In turn, the frequency resolution requirements depend on the needs of the particular system and user. One bit of video may be sufficient for transmitting information which may be either black or white only, such as typewriting. Three bits may be sufficient to transmit a good quality gray scale picture in some applications, and additional bits per pixel may be needed in other applications to increase further the resolution of the gray scale.

In an FM analog facsimile system, video intensity (i.e., gray scale value) is represented as a frequency within a range bounded by two extreme frequencies; one extreme corresponds to a nominally black condition and the other to a nominally white condition. In typical facsimile applications, the analog value of image intensity normally may be quantized within this range to one of eight levels without noticeable degradation of the reproduced copy as compared with the original image. The number of levels may even be reduced to five or six without loss of acceptable fidelity. Therefore, video information samples can be transmitted by a facsimile system as the nearest one of 5 to 8 discrete frequency values. This degree of quantization (or approximation) requires only three bits per sample. Synchronization, handshaking and supervisory functions may be provided with the addition of at most three additional discrete frequencies outside the video range (i.e., two bits); half-duplex units generally use just one additional frequency (i.e., one bit). At a maximum, usually no more than eight bits of quantization i.e. 256 gray scale values would be employed.

In accordance with the present invention, therefore, the source image is scanned by the facsimile unit at a fixed, constant rate; and for each line the analog FM output of the scanner is sampled at a constant rate, also. For each sample, the dominant frequency thereof is found; this dominant (or characterizing) frequency then is quantized as a digital signal representing the closest one of a discrete number of available frequency values.

These digital samples are written into a memory at the fixed sampling rate and then are read out from the memory at a pseudorandomly variable later time (i.e., with a pseudorandum delay relative to the input). The delayed digital samples may be transmitted directly over a communications channel, to the receiving site, or they may be converted back to an analog form first. In either case, either prior to or following the delay-establishing operation, the digital sample values may be mapped or transformed to other digital values, to scramble the frequency representation and further enhance the security of the transmission.

At the intended destination, a receiving unit is synchronized with the transmitting unit. The receiving unit reverses the effect of the pseudorandom time variation established at the transmitter by feeding the received signal into a similar memory at the same pseudorandom rate and then reading the information out of the memory at a constant rate, thereby giving rise to an "inverted" delay pattern at the receiver. Overall, therefore, the sum of the two delays is a constant value.

Barring transmission errors, the recovered digital version of the facsimile signal is the same as the "scrambled" quantized facsimile signal. The digital scrambling transformation is reversed and the "clear" digital facsimile signal is recovered. The signal is then supplied to a digital-to-frequency converter which, in turn, drives an analog display device to provide a clear copy of the original message or document.

BRIEF DESCRIPTION OF THE DRAWINGS

These and other features and objects of the present invention will be more fully understood from the following detailed description of an illustrative embodiment, which should be read in conjunction with the accompanying drawing in which.

DESCRIPTION OF AN ILLUSTRATIVE EMBODIMENT

Figure 1:
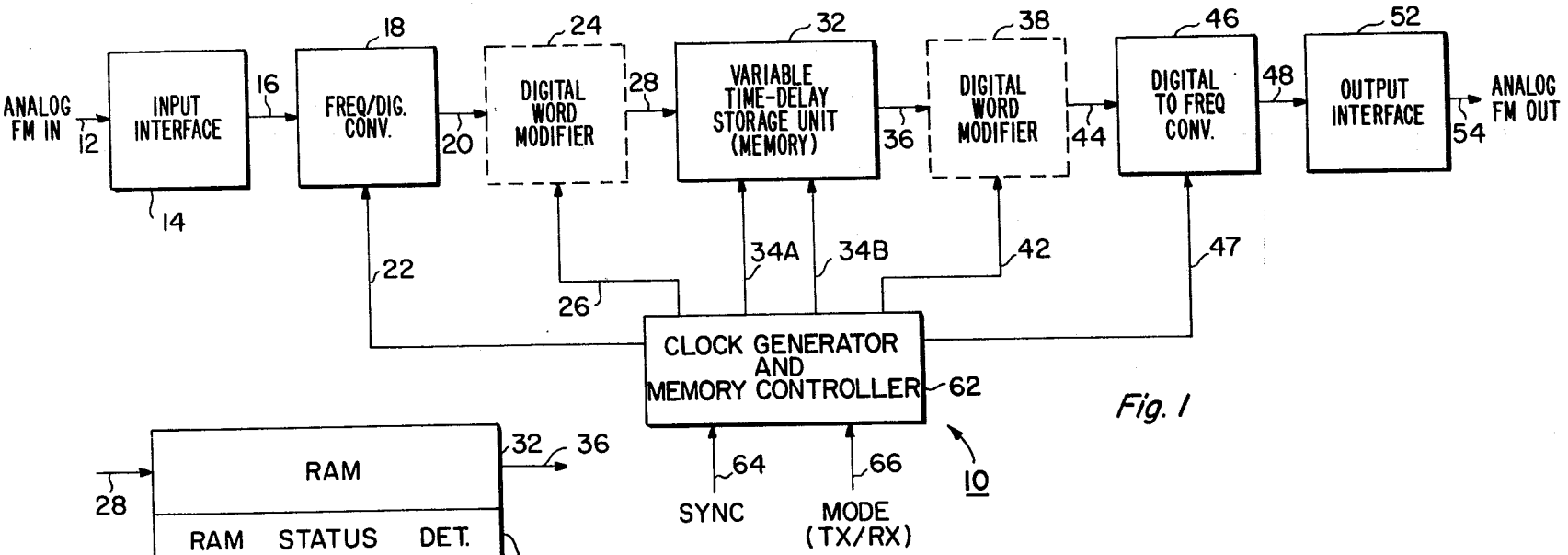
FIG. 1 is a simplified block diagram of signal processing apparatus according to the present invention, for transmission or reception.

Referring now to FIG. 1, there is shown a general block diagram of signal processing apparatus 10 for a secure facsimile transmission system according to the present invention. It may be used at either the transmitter or the receiver. Briefly, the operation of this system for transmission may be described as follows. A conventionally generated, clear analog FM facsimile signal is supplied to the transmitter processing unit on line 12. The input signal on line 12 is received by an input interface 14 which performs impedance matching and level adjusting to match the scanner output to the remainder of the processing circuitry. If necessary, the input interface also may include filters to remove noise and out-of-band hum from the input signal.

The output of the input interface 14 is supplied on line 16 to a frequency-to-digital converter 18 which converts the signal on line 16 to a binary word representing frequency, supplied on line 20. A typical converter first may convert the sine-wave signal on line 12 into a square wave, and then count the number of pulses in a high-frequency clock signal (provided, e.g., on line 22 by timing and control circuit 62) which occur between successive positive-to-negative or negative-to-positive transitions of the squared signals. This number of clock pulses is represented as a digital word which indicates of the frequency of the signal on lines 12 and 16.

Optionally, the output of the frequency-to-digital converter is next supplied on line 20 to a (first) digital word modifier 24, shown in dashed lines. The digital word modifier 24 also receives clocking signals on line 26 from clock generator and memory controller 62. The word modifier can be used to alter or transform the representation of the sample value on line 20, to provide a different representation on line 28. Appropriate modifications can include changes in quantization (to facilitate storage, for example) and transformations which substitute for each digital word on line 20 a different (i.e., scrambled or encrypted) digital word. The decision whether to use a digital word modifier will depend on the user's needs. If, for example, there is sufficient storage capacity to accommodate eight-bit words, a modifier is not necessary other than to scramble values.

Next, the signal on line 28 is supplied to a variable time-delay storage unit or memory 32. The storage unit 32 receives read/write and chip enable control signals on lines 34A and 34B, a well. Typically, storage unit 32 is a RAM (i.e., random-access read/write memory) assembly. Data on line 28 is written into sequential addresses of the memory 32 at a constant clocking rate, but is read out therefrom sequentially at a variable rate. This creates a variable time delay between the writing and reading of each word.

Naturally, since the memory 32 is of finite size, constraints exists on the relationship between the read-out rate and the write-in rate. Data written into the memory must be read-out before it is destroyed by a subsequent attempt to write new data at the same address. Conversely, no attempt should be made to read an address before proper data has been written there. Thus, if the data is written into the RAM at a constant rate, the time delay between input and output of each word may vary between zero and the time necessary to fill the RAM; over the long term, though, the number of words read during an interval must be the same as the number written.

The output from the storage unit (i.e., memory) 32 is provided on line 36 to a second, also optional, digital word modifier 38 which is clocked via line 42. In turn, the output of the digital word modifier 38 is supplied via line 44 to a digital-to-frequency converter 46 which is clocked via line 47. The digital word modifier 38 transforms the digital word on line 36, as it had been stored in the RAM, to one which, when applied to the digital-to-frequency converter 46 will produce the desired output frequency. Digital word modifier 38 may, for example, provide the inverse transformation as that provided by digital word modifier 24; this would be appropriate if the only modification done by word modifier 24 is intended to facilitate storage.

It should be noted that digital word modifiers 24 and 38 may be ROM's (i.e, read-only-memory), parts of the same ROM, digital logic, etc. One or both of the digital word modifiers may be omitted without altering the significance or value of the time-delay modulation technique described herein.

Digital-to-frequency converter 46 typically may be a down counter which counts the number of clock pulses as a function of the digital word applied to it. It may include a squaring and filter circuit to produce a sine-wave at the desired frequency.

Finally, the output of digital-to-frequency converter 46 is supplied via line 48 to an output interface 52. The output interface transforms the signal on line 48 to the level required for transmission downstream via line 54; it also matches the impedance of the processing circuitry to the impedance level appropriate for driving line 54.

Clocking and control signals are supplied to the various stages of the transmitter processing unit 10 by clock generator and memory controller 62. Typically, for synchronization of the transmitting (i.e., encoding) unit with the receiving (i.e., decoding) unit, the transmitting unit will transmit a synchronizing signal using FSK or PSK modulation before beginning a scrambled transmission, to enable both units to provide the proper starting conditions. This synchronization signal is received by clock generator and memory controller 62 on line 64.

A desirable characteristic of the present invention is that basically the same hardware may be used both for scrambling at the transmitter and for unscrambling at the receiver. Then the equipment in FIG. 1 may be set up to perform both transmit and receive functions. When this is done, an additional signal must be provided on line 66 to the clock generator and memory controller 62 to select the mode of operation (i.e., transmit or receive). This signal may be omitted if the processing equipment is dedicated either to transmission or to reception.

Primarily, reception differs from transmission in that different timing and control signals must be supplied to variable time-delay storage unit 32 in order to provide an "inverse" time-delay pattern during receive operation.

For use with an analog FM facsimile system designed for communication over telephone channels, clock generator and memory controller 62 must provide clock pulses at a much higher than audio rate, so that the frequency of each sample may be defined adequately. A 250 kHz clock, for example, is suitable for this purpose.

The period (and, therefore, the frequency) of each cycle of the analog signal on line 16 is determined by counting the number of 250 kHz clock pulses in this cycle. The frequency-to-digital converter 18 may, for example, provide an eight-bit number representing the period.

If optional digital word modifier 24 is used, this number is applied as part of the address to a PROM (Programmable Read-Only Memory) which constitutes that digital word modifier. The PROM provides an output comprising one of seven possible three-bit binary numbers. These numbers represent selected frequencies corresponding to the seven available gray-scale levels. Thus, each number generated by the PROM represents the one of the seven selected frequencies which, for that pixel, is closest to the input frequency. If the input is outside of the specified range, the output is zero.

The three-bit binary numbers provided by the digital word modifier 24 or the eight-bit words from the frequency-to-digital converter 18 are entered at a constant rate, such as 2.5–10 kHz, into a RAM which comprises the variable time-delay storage unit or memory 32. If, for example, the RAM comprises one 4096 bit memory for each bit in the words stored, it will take from 0.4096 to 1.6384 seconds to fill the RAM 32.

The three-bit binary numbers are read out of the RAM in the same sequence as that in which they were written in, but with a varying rate. The read-out rate may vary, for example, from about 70 to about 140 percent of the constant write-in rate.

If a second (optional) word modifier 38 is used, the output of the RAM 32 is applied thereto as part of the address of a PROM. PROM 38 outputs one of seven eight-bit numbers corresponding to one of seven possible frequencies associated with available gray levels, assuming that three-bit words were stored in RAM 32. If the three-bit input number was zero, a blanking signal results.

A single PROM may be used for both word modifiers 24 and 38, in which case other portions of the address determine whether the PROM will operate as an eight-bit to three-bit converter or a three-bit to eight-bit converter, permitting the PROM to be time-shared by input and output circuits.

The (eight-bit) number output of the PROM 38, or of RAM 32 if PROM 38 is omitted, is applied on line 44 as the control signal to a down counter and flip-flop comprising the digital-to-frequency converter 46. This down counter and flip-flop synthesize the specified frequencies indicated by each of the eight-bit numbers on line 44.

From a hardware economy point of view, it is probably preferable to omit the digital word modifiers 24 and 38 unless they are needed to implement a transposition (or scrambling) of numerical respresentations for frequency valves.

Figure 2:
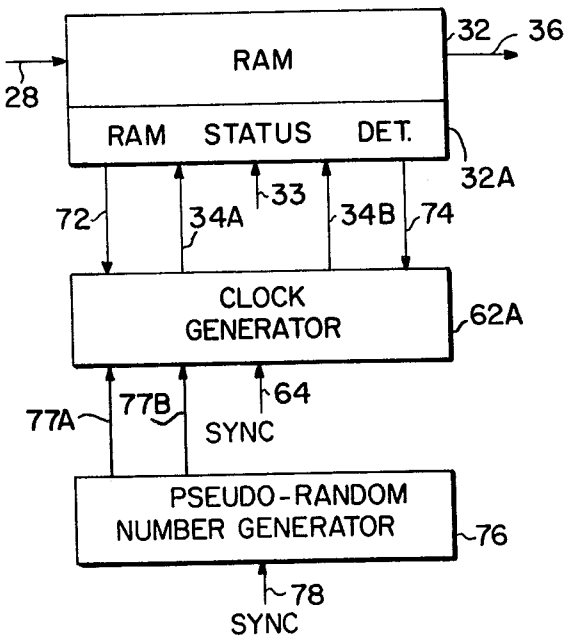
FIG. 2 is a block diagram expanding and particularly illustrating the time-delay modulator/demodulator in part on the block diagram of FIG. 1.

FIG. 2 provides a slightly more detailed block diagram useful for illustrating how RAM 32 is controlled to provide a variable time-delay. RAM 32 has been equipped with a RAM status detector 32A. The purpose of the RAM status detector 32A is to detect incipient underflow and overflow conditions in the RAM—i.e., incipient emptying and filling up of the RAM. When an incipient underflow is detected, a signal is sent from the RAM status detector 32A to clock generator 62A (part of the clock generator and memory controller 62 of FIG. 1) via line 72. Conversely, the detection of an incipient overflow sends a signal via line 74 to clock generator 62A.

The presence of an incipient underflow signal on line 72 causes clock generator 62 to provide a read-out control (i.e., chip enable) signal on line 34B at a rate below the constant rate write-in control signal (also) provided on line 34B, at different times), while an incipient overflow signal on line 74 has the opposite effect—i.e., it causes a read control signal to be provided on line 34B at a rate greater than the constant write-in rate.

As explained in greater detail below, a particularly practical technique is to employ as control rates, for example, two rates which exceed the constant write-in rate and two rates which are below the write-in rate. A pseudo-random number generator 76, which supplies a first pseudo-random number on line 77A to the clock generator, selects which of the two "high" or "low" rates is to be employed when a rate change is made.

In addition, the pseudo-random number generator 76 may supply a second pseudorandom number (which may be just one bit) on line 77B to inject a pseudo-random change of rate, which is in addition to the rate change initiated by the detection of incipient underflow or overflow by the RAM status detector 32A. Further, this second pseudorandom number may be used to change the "fast" or "slow" character of the variable rate signal, causing random reversals in either direction. This may be permitted to occur at random times or at preselected times.

Pseudo-random number generator 76 is supplied with a synchronization signal on line 78. The same pseudo-random number sequence is provided at the transmitting and receiving locations by like generators; and both pseudo-random number generators are initialized and synchronized by the same signal. Therefore, except for transmission delays, both pseudo-random number generators operate in a lock-step relationship.

As described more fully below, RAM status detector 32A may be a pair of counters and some associated logic. A first counter operates at the fixed write-in clock frequency to select the RAM locations address-by-address, in sequence, at a constant rate. It is initialized to a predetermined count by the synchronization signal provided on line 33. A second counter operating at a variable clock frequency sequentially addresses the RAM locations at a variable rate. The counter operating at a fixed frequency controls transmit (i.e., encoding) writing into the RAM and receive (i.e., decoding) reading from the RAM. Conversely, the counter clocked at a variable rate controls the reading of RAM contents for transmission and the writing into the RAM for reception. The fixed rate counters at both transmission and receiving sites, and the addresses they indicate, are synchronized with each other, with allowance made for system delay. Similarly, the variably clocked counters are in synchronism.

For simplicity, the fixed-clock-rate counters will be referred to as the "A" counters below, and the variable-clock-rate counters will be referred to as the "B" counters.

Figure 3:
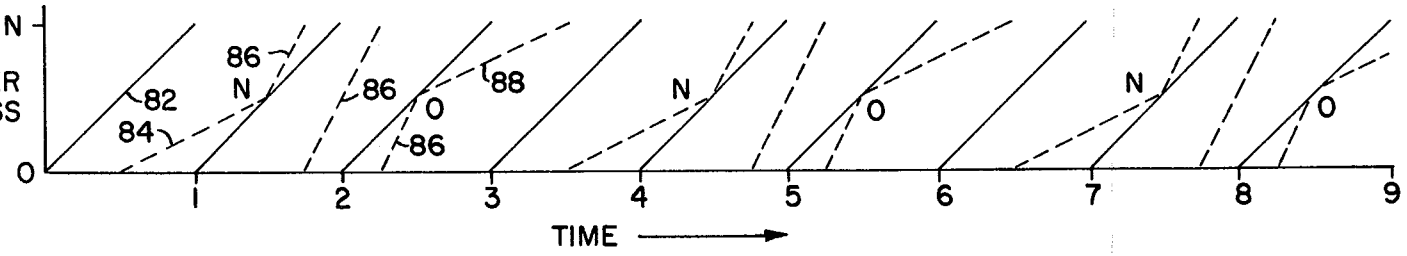
FIG. 3 is an illustration of the addresses indicated by the RAM status counters, as a function of time, showing the changing of the fast/slow status of the read-out rate, to avoid memory underflow and overflow.

In FIG. 3, the operation and relationship between the counters is shown. The diagram in FIG. 3, to be more specific, illustrates the RAM addresses indicated by the counters, as a function of time. The solid lines represent the addresses of the transmit write and receive read counters (i.e., the A counter), while the dashed lines represent the addresses indicated by the transmit read and receive write counters (i.e., the B counter). A N-word RAM is illustrated. Each unit of the abscissa represents the time needed to fill the transmit RAM at the fixed write-in rate with the read-out clock stopped.

Time zero represents the time of initial synchronization. There is an initial lag between the time the first word is written into the RAM and the time that it is read out, equal to one-half the time needed to fill the RAM at the constant write-in rate. Thus, the transmit write address counter records an address varying from zero to N between time zero and the end of the first time unit. Line 82 represents the transmit write counter contents (i.e., the write address) during that interval. The slope of line 82 is proportional to the writing rate.

At some time between 0 and 1.0, such as time 0.5, the transmit read operation begins. The transmit read counter address is represented by line 84. In the particular illustration shown in FIG. 3, the transmit read clock may run at either one-half or twice the rate of the constant rate transmit write and receive read clocks. Thus, the slope of the dashed lines will be either one-half or twice that of the solid lines. Generally, however, it is preferable to limit the variable clock rate to the range of about 70–140% of the fixed rate. The 50% and 200% rates are shown in the example only because they are easy to illustrate. Line 84, in the time inverval 0.5 to 1.5 has a slope of one-half that of line 82. Thus, the RAM 32 is being emptied only half as fast as it is being filled. Naturally, this will lead to a RAM overflow condition on the clock cycle immediately following that which uses up the "cushion" provided by not having started the read out until the RAM was half full. The incipient overflow condition is represented by the letter N which is placed at the point where the transmit write and read addresses are equal. To prevent overflow, the transmit read rate is switched to a value higher than the constant transmit write rate when the addresses of the two counters are equal. This higher rate is represented by the slope of line segment 86 which, in the present example, is twice the slope of line 82. Eventually, an underflow condition will be imminent, as represented by the letter O at time 2.5. Detection of that condition causes the transmit read rate to again be switched, this time to a rate below that of the transmit write rate, represented by the slope of line 88.

As indicated above, a number of clocking rates may be employed, so long as there is at least one "slow" rate and one "fast" rate (i.e., slower than or faster than the constant writing rate, respectively). If more than one rate is available in each category, any convenient method may be used for selecting which one of the available fast or slow rates will be employed at any given time, once the category has been chosen. The sole requirement is that avoidance of overflow triggers the usage of a fast rate and avoidance of underflow triggers the usage of a slow rate, for the transmit read control signal. The converse is true, of course, in the case of the receive write control signal.

In addition, as mentioned above, the selection of control signal rates from among the menu of available rates may be varied at random times, as may the fast/slow category selection. So long as incipient underflow and overflow conditions are detected and trigger the use of an appropriate use of category of clock rate, for at least one clock period, an acceptable randomly varying delay pattern will be provided.

Figure 4:
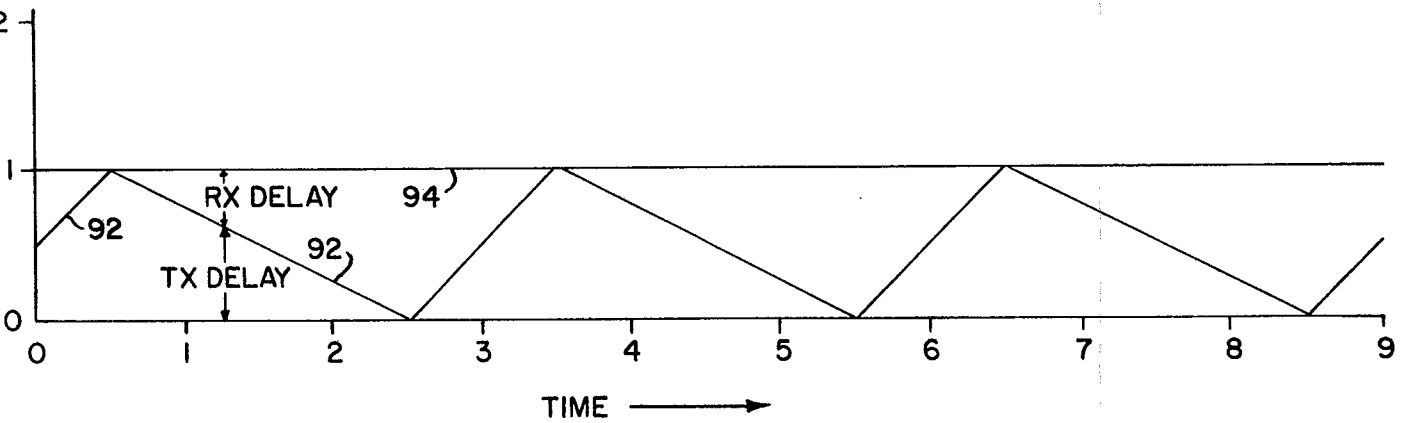
FIG. 4 is an illustration of a typical time delay pattern provided at the transmitter and receiver according to the present invention pursuant to the clocking pattern of FIG. 3.

Relevant time delays are illustrated in FIG. 4, on the same time scale as FIG. 3, for the pattern illustrated in the latter Figure. Line 92 represents the delay introduced by the transmitter and line 94 represents the overall delay between the input to the transmit RAM and the output from the receiver RAM. The distance between the two curves is the time delay provided at the receiver.

Figure 5:
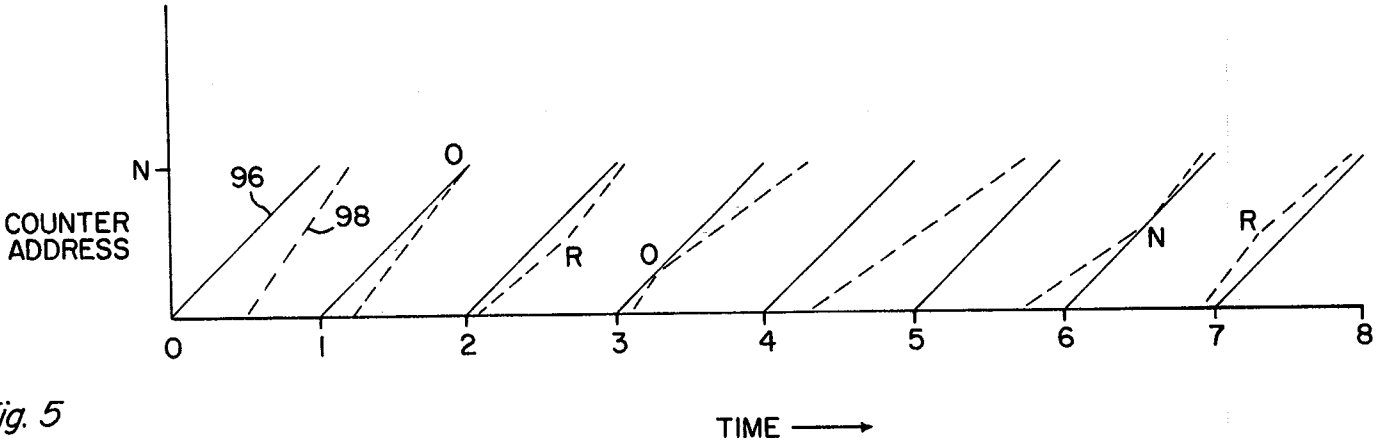
FIG. 5 is an exemplary illustration of the addresses indicated by the RAM status counters, as a function of time, when two fast and two slow rates are available, with a pseudorandum reversal of fast/slow rate category section.
Figure 6:
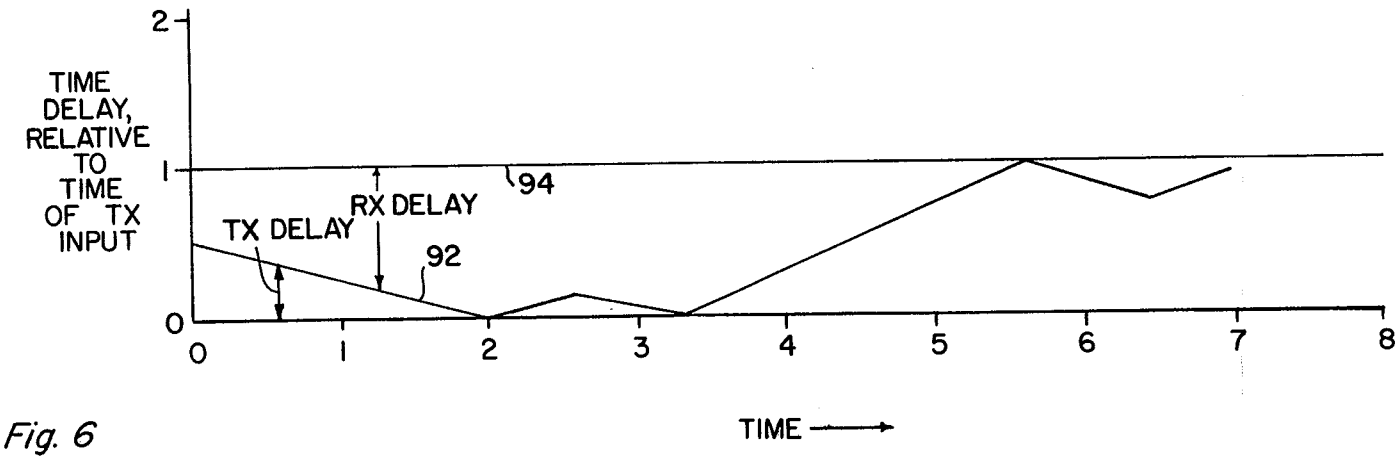
FIG. 6 is an illustration of the time delays resulting from the rate variation pattern of FIG. 5.

FIG. 5 is analogous to FIG. 3 and illustrates the use of two fast rates and two slow rates for transmit RAM reading. The two slow rates are 70 and 85% of the writing rate and the two fast rates are 125 and 140% of the writing rate. One-half way (address-wire) through the read out operation, the fast/slow category selection may be reversed pseudo-randomly. Within each category, the choice of rate also is made pseudo-randomly from among the available possibilities. As in FIG. 3, the solid line 96 represents the address of the A counter, while the dashed line 98 represents the address of the B counter. The Letter R indicates fast/slow rate category reversals. FIG. 6 shows the time-delay pattern established in FIG. 5.

Figure 7:
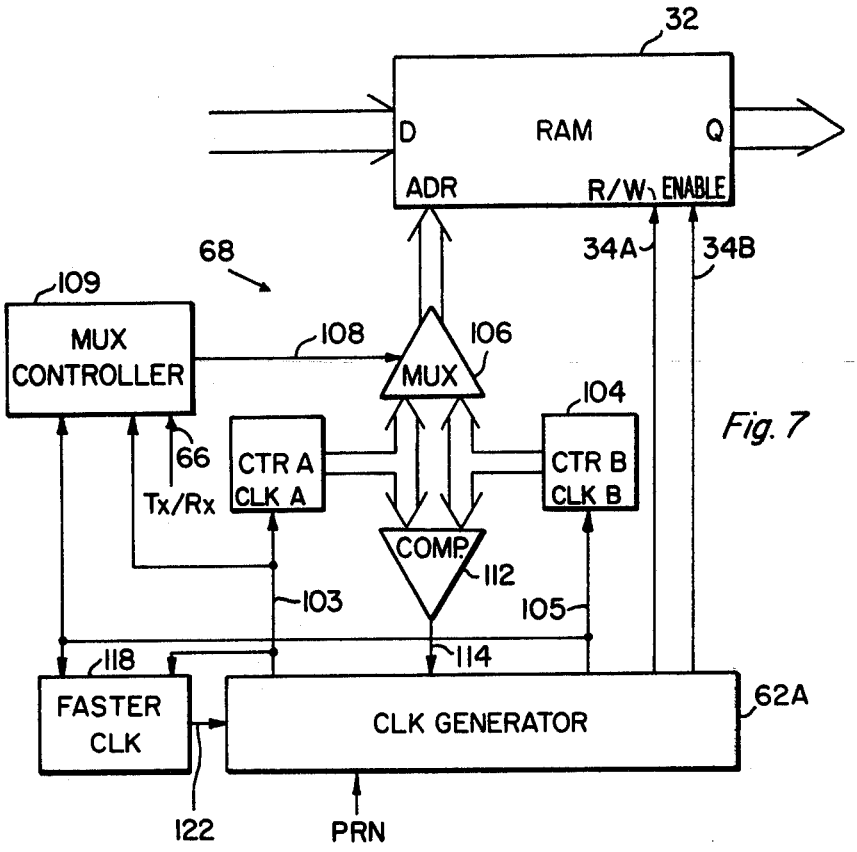
FIG. 7 is an expanded block diagram of the time-delay modulator of FIG. 2, particularly illustrating RAM underflow/overflow control.

Underflow/overflow protection for the RAM, with associated control signal rate switching, is illustrated in FIG. 7. As shown therein, the primary components of RAM control are a pair of counters 102 and 104, designated the "A counter" and "B counter," respectively.

The counters 102 and 104 operate in conjunction with a pair of clocking signals provided by the clock generator on lines 103 and 105, respectively. The signal on line 103 is the fixed rate clock, designated CLKA, and the signal on line 105 is the variable rate clock, designated CLKB. A multiplexer (i.e., MUX) 106, responsive to a control signal on line 108 from MUX controller 109 determines which counter addresses the RAM at any moment. During the transmit operation, the A counter provides addresses for writing and the B counter provides addresses for reading; the roles are reversed in receive operation.

In the transmission mode, both counters 102 and 104 are initialized to a count of zero and counter 104 is held at that count until counter 102 has reached time 0.5, or some other preselected time between 0 and 1. (Equivalently counter 102 may be preset to a preset to a predetermined count and counter 104, to zero.) As data is written into the RAM, the count recorded by A counter 102 is incremented upward, word by word, so as to address sequentially the locations of the RAM during successive write operations. The address determined by A counter 102 is incremented in association with the CLKA signal.

Read out addressing of the RAM is controlled by the CLKB signal. The clock generator 62A controls the selection of the CLKB clocking rates, as set forth above. B counter 104 addresses the RAM word by word, through MUX 106, starting from the initial count and incrementing each time a digital word is read.

Actual writing into and reading from the RAM are controlled by read/write (R/W) control and chip enable signals provided to the RAM on lines 34A and 34B, respectively, by the clock generator 62A. (Some RAM's use different control formats, and suitable control signals would, of course, be provided, as required. Whatever control signals are in use are synchronized with the CLKA and CLKB signals such that the counters have a chance to increment and the MUX 106 has a chance to set up before a read or write occurs.

Basically, the A and B counters 102 and 104, together with MUX 106 and MUX controller 109 comprise the memory controller 62B part of clock generator and memory controller 62 of FIG. 1.

A comparator 112 monitors the addresses indicated by counters 102 and 104, to signal the clock generator 62 when the RAM is on the verge of experiencing an underflow condition. That is, when the addresses indicated by the counters are the same, comparator 112 detects incipient underflow and signals the clock generator via line 114. In response, the clock generator selects a below-nominal writing (i.e., slow) rate for CLKB, thereby permitting a word to be written into the RAM on the next CLKA cycle before an attempt is made to read it out on the CLKB cycle which follows.

Conversely, the RAM may be filling faster than it is being emptied, leading to a potential overflow and loss of data through overwriting at a RAM address. Comparator 112 also guards against this situation. When the incrementing of counter 102 causes it to "catch up" to counter 104, so that they indicate the same address for reading and writing, comparator 112 similarly signals the clock generator via line 114, to change the rate of the CLKB signal.

Thus, the output of comparator 112 can indicate either incipient underflow or incipient overflow. Which condition is intended depends on whether CLKB was running faster or slower than CLKA. Therefore, (figuratively, at least) a faster clock detector 118 is used to monitor both clock signals (or, equivalently, their selection signals) and to provide a signal on line 122 to the clock generator 62 indicating whether CLKB is running slower or faster than CLKA. The clock generator chooses a "fast" or "slow" rate for the CLK2 signal according to the state of the signal on line 122 when the signal on line 114 communicates the need for a reversal of the clock speed relationship.

The operation of the RAM and its associated control circuitry is only slightly different in receive mode. First, the use of the A and B counter (and, hence, the CLKA and CLKB signals) is reversed; the B counter controls writing into the RAM and the A counter controls read out from the RAM.

A transmit/receive function selection signal, TX/RX, is supplied to the MUX controller 109 on line 66, and effects the proper use of the counters. The timing of the MUX's switching between counters within each mode (i.e., transmit or receive) is effected by the MUX controller 109 responsive to CLKA and CLKB signals.

Figure 8:
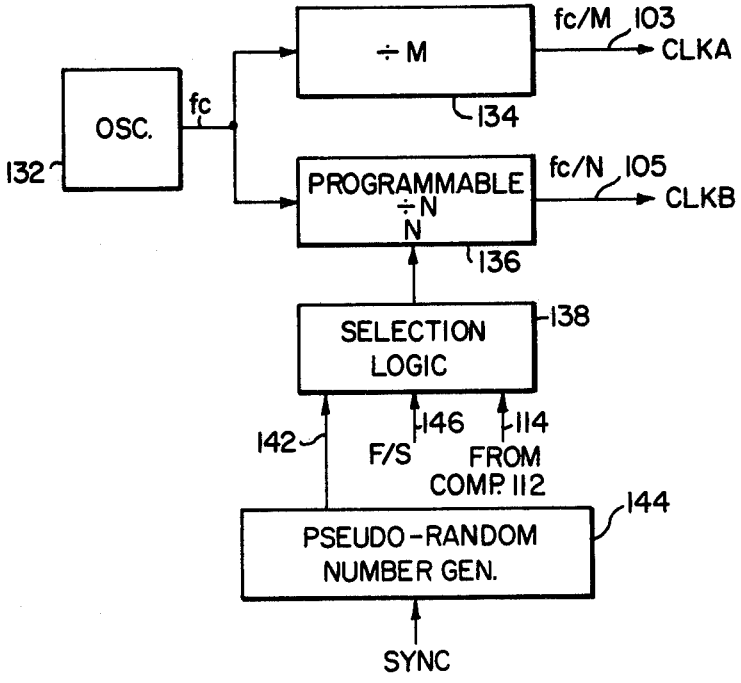
FIG. 8 is a block diagram for clock generator 62A of FIGS. 2 and 7.

A block diagram of the clock generator 62 is provided in FIG. 8. As shown therein for simplicity, both the fixed-rate clock CLKA and the variable-rate clock CLKB are derived from a common oscillator 132 operating at a frequency fc. The oscillator output drives two dividers 134 and 136. Divider 134 employs a constant frequency division factor, M, to generate the fixed rate clock CLKA. By contrast, divider 136 is a programmable divide-by-N counter and is used to generate the variable rate clock CLKB in accordance with variations of the division factor N.

Selection logic 138 chooses the division factor N from one of a number of available factors, some greater than and some less than M. As illustrated in FIGS. 5 and 6, there may, for example, be four choices for M, two to produce "fast" clocks and two to produce "slow" clocks. In selecting the factor N from the set of available possibilities, selection logic 138 is responsive to at least two signals, the incipient underflow/overflow signal provided line 114 and a pseudorandom number (PRN) provided on line 142 by a pseudorandom number generator 144. The vlue of the PRN determines which of available higher-than-M (i.e., "high") or lower-than-M (i.e., "low") values of N will be used at any given time, and the underflow/overflow signal determines whether N will be chosen from the high or low group. Optionally, but preferably, the selection logic 138 also is responsive to a single pseudo-random bit on line 146, designated the fast/slow reversal (i.e., F/S) bit. When this bit appears in a designated state, the selection logic switches from a high M to a low M, or vice versa, causing the CLKB signal to reverse from a fast rate to a slow rate or from a slow rate to a fast rate. The F/S bit may be allowed to appear at any time or it may be restricted to appearing only at a specified time—e.g., half way through the RAM read or write addressing.

The mean rate of change of state of that bit, of course, should be sufficiently slow as to permit the signal on line 114 to produce the majority of rate change reversals; otherwise, the system could get "hung up" changing clock rate every word or two, thereby wasting the range of time-delay variation available.

The pseudorandom fast/slow reversal signal may be obtained from the same pseudorandum number generator 144 that provides the PRN signal on line 142, as illustrated, or from a separate pseudorandom number generator, not shown. If a second generator is used, both it and the PRN signal generator must be synchronized so as to start running simultaneously at the receiver and transmitter with the same respective initial states at both locations.

It should be understood that the use of the fast/slow reversal signal is optional and that more or less than the illustrated number of faster and slower than nominal clock rates may be employed. The instantaneous rate of the variable clock, CLKB, is determined, therefore, by the concordance of several factors and is quite random, within the limits of the rates which are available.

By using incipient underflow and overflow as the overriding criteria for fast/slow reversal, the long-term average period and, equivalently, number of bits or cycles in the variable rate clock, is maintained equal to those parameters of the fixed rate clock. This is the essential criteria for preventing loss of information.

Having thus described an embodiment of the invention, it will be apparent that various alterations, modifications and improvements will readily occur to those skilled in the art. It is intended that such alterations, modifications and improvements be and are within the scope of this invention. Thus, the foregoing description is illustrative only, and should not be considered limiting on the scope of protection; rather the invention is limited only according to the claims appended below, and equivalents thereto.

What is claimed as new and desired to be secured by Letters Patent of the United States is:

1. A system for providing secure transmission of an analog sourcesignal over an unsecured channel, between a transmitting site and a receiving site, comprising:

at the transmitting site:

means for converting the analog source signal into a sequence of digital words each of which represents the instantaneous value of that signal at a particular sampling time;

means for storing a finite multiplicity of the digital words;

means for providing a first clocking signal at a first rate;

means for writing the digital words into the storing means responsive to the first clocking signal;

means for providing a second clocking signal at a second rate;

means for reading said digital words out of said storing means responsive to the second clocking signal;

the long-term time average of the periods of the first and second clocking signals being equal;

at least one of the first and second rates being pseudo-randomly variable, whereby the time between writing a digital word into the storage means and reading such digital word from the storage means is pseudo-randomly variable;

means for converting the digital words read from the storage means to a frequency-modulated analog signal for transmission over the unsecured channel; and at the receiving site:

means for converting the analog signal received over the unsecured channel into a second sequence of digital words, each of which represents the instantaneous value of such analog signal at a particular sampling time;

such means for converting the analog signal into digital words including means for sampling such analog signal responsive to the third clocking signal;

means for providing a third clocking signal at a third rate;

means for storing a finite multiplicity of the digital words of the second sequence;

means for writing the digital words into such storing means responsive to the third clocking signal;

means for providing a fourth clocking signal at a fourth rate;

means for reading said digital words out of said storing means responsive to the fourth clocking signal;

said third and fourth rates being selected such that the time average of the period of each is the same as the time average of the periods of the first and second clocking signals;

the further clocking signal further being selected such that the time between writing a digital word into the storing means at the transmitting site and reading such digital word from the storing means at the receiving site is constant; and means for converting the digital words read from the storing means at the receiving site to an analog signal for use at the receiving site.

2. The system of claim 1 wherein the analog source signal is frequency modulated.

3. The system of claim 1 wherein the analog source signal is not frequency modulated and wherein the means for converting the analog source signal into a sequence of digital words includes:

means for converting the analog source signal into a frequency-modulated signal; and means for converting the frequency-modulated signal into a sequence of digital words.

4. The system of claim 1 or claim 2 wherein the analog source signal is a facsimile signal.

5. The system of any of claims 1–3 wherein the means for providing the second clocking signal includes means for pseudorandomly varying the instanteous rate thereof.

6. The system of claim 5 wherein the means for providing the third clocking signal includes means for varying the rate thereof in like manner as the rate of the second clocking signal is varied.

7. The system of claim 5 wherein the first and fourth rates of the first and fourth clocking signals, respectively, are constant.

8. The system of any of claims 1–3 further including, at the transmitting site, means for preventing underflow and overflow of the storage means.

9. The system of claim 5 further including, at the receiving site, means for preventing underflow and overflow of the storage means.

10. The system of claim 5 wherein the means for pseudorandomly varying the rate of the second clocking signal includes means for selecting such rate from among a plurality of available clocking rates at least one of which is faster than said first rate and at least one of which is slower than said first rate.

11. The system of claim 10 further including, at the transmitting site:

means for detecting incipient underflow of the storage means;

the means for providing the second clocking signal being responsive to the means for detecting incipient underflow to select, in response thereto, for the instantaneous value of the second rate, a rate slower than said first rate.

12. The system of claim 10 wherein a plurality of clocking rates slower than the first rate are available for selection as the second rate, as well as a plurality of clocking rates faster than the first rate, and wherein the means for providing the second clocking rate includes means for selecting the second rate pseudo-randomly from among the available rates slower and faster than the first rate.

13. Apparatus for transmitting a scrambled version of an analog source signal, comprising:

means for providing a first clocking signal and a first rate;

means for providing a second clocking signal at a second rate;

means for converting the analog source signal into a sequence of digital words, each of which represents the instantaneous value of the analog signal at a particular sampling time defined by the first clocking signal;

means for storing a finite multiplicity of the digital words;

means for writing the digital words into the storing means responsive to the first clocking signal;

means for reading the digital words out of the storing means responsive to the second clocking signal;

the long-term time average of the periods of the first and second clocking signals being approximately equal; means for varying pseudo-randomly at least one of the first and second rates, whereby the time between reading a digital word into the storage means and reading such digital word from the storage means is pseudo-randomly variable;

means for detecting incipient underflow or overflow of the storage means;

means responsive to the underflow/overflow detection means for changing the instantaneous value of at least one of the first or second clocking rates, to prevent underflow or overflow; and means for converting the digital words read from the storage means to a frequency-modulated analog signal for secure transmission over an unsecure channel.

14. The apparatus of claim 13 wherein the first rate is constant and the means for varying pseudorandomly at least one rate includes means for selecting the instantaneous value of the second rate pseudo-randomly from among a plurality of available rates, at least one of which is faster that the first rate and at least one of which is slower than the first rate.

15. The apparatus of claim 14 further including a fixed frequency oscillator means for dividing the frequency of the oscillator by a constant factor to provide the first clocking signal and programmable divider means for dividing the frequency of the oscillator by a programmable factor, N, to provide the second clocking signal.

16. The apparatus of claim 13 wherein the analog source signal is not frequency-modulated and the means for converting the analog source signal into a sequence of digital words includes:

means for converting the analog source signal to an analog frequency-modulated signal; and means for converting the analog frequency-modulated signal into a sequence of digital words, each of which represents the instantaneous frequency of the analog frequency-modulated signal at a particular sampling time defined by the first clocking signal.

17. The apparatus of any of claims 13–16 wherein the means for detecting incipient underflow or overflow includes a first counter for recording the last address location in the storing means to which data was written and a second counter for recording the last address location in the storing means from which data was read, and means for comparing the addresses recorded by the counters, said comparing means providing a signal indicating incipient underflow or overflow when the addresses are equal.

18. The apparatus of any of claims 13–15 wherein the analog source signal is frequency-modulated.

19. The apparatus of claim 18 wherein the analog source signal is a facsimile signal.

20. Apparatus for transmitting a scrambled version of a source signal, comprising:

means for providing a first clocking signal and a first rate;

means for providing a second clocking signal at a second rate;

means for converting the source signal to an analog frequency-modulated signal; and means for converting the analog frequency-modulated signal into a sequence of digital words, each of which represents the instantaneous frequency of the analog frequency-modulated signal at a particular sampling time defined by the first clocking signal means for storing a finite multiplicity of the digital words;

means for writing the digital words into the storing means responsive to the first clocking signal;

means for reading the digital words out of the storing means responsive to the second clocking signal;

the long-term time average of the periods of the first and second clocking signals being approximately equal; means for varying pseudo-randomly at least one of the first and second rates, whereby the time between reading a digital word into the storage means and reading such digital word from the storage means is pseudo-randomly variable;

means for detecting incipient underflow or overflow of the storage means; and means responsive to the underflow/overflow detection means for changing the instantaneous value of at least one of the first or second clocking rates, to prevent underflow or overflow.

* * * * *